US009976327B2

(12) United States Patent
Dreisewerd

(10) Patent No.: US 9,976,327 B2
(45) Date of Patent: May 22, 2018

(54) RECESSED DOOR HINGE

(71) Applicant: SIMONSWERK GmbH, Rheda-Wiedenbrueck (DE)

(72) Inventor: Nikolaus Dreisewerd, Rietberg (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 12 days.

(21) Appl. No.: 15/223,107

(22) Filed: Jul. 29, 2016

(65) Prior Publication Data

US 2017/0030122 A1 Feb. 2, 2017

(30) Foreign Application Priority Data

Jul. 31, 2015 (DE) ..... 10 2015 112 640

(51) Int. Cl.
*E05D 7/04* (2006.01)
*E05D 3/18* (2006.01)
(Continued)

(52) U.S. Cl.
CPC ..... *E05D 7/0423* (2013.01); *E05D 3/06* (2013.01); *E05D 3/18* (2013.01); *E05D 3/186* (2013.01); *E05D 5/02* (2013.01); *E05D 7/0045* (2013.01); *E05D 7/0415* (2013.01); *E05D 2007/0476* (2013.01); *E05D 2007/0484* (2013.01); *E05Y 2900/132* (2013.01)

(58) Field of Classification Search
CPC .... E05D 3/06; E05D 3/12; E05D 3/14; E05D 3/142; E05D 3/125; E05D 3/127; E05D 3/18; E05D 3/183; E05D 3/186; E05D 7/04; E05D 7/0423; E05D 7/0415; E05D 7/043; E05D 7/0027; E05D 7/0045; E05D 5/02; E05D 2007/0438; E05D 2007/0446; E05D 2007/0453; E05D 2007/0461; E05D 2007/0469; E05D 2007/0484; E05D 2007/0492; E05D 2007/0476
See application file for complete search history.

(56) References Cited

U.S. PATENT DOCUMENTS 2,608,713 A * 9/1952 Soss ..... E05D 3/186 16/337
3,001,224 A * 9/1961 Soss ..... E05D 3/16 16/276

(Continued)

FOREIGN PATENT DOCUMENTS

JP 6-288139 A 10/1994

*Primary Examiner* — Jeffrey O'Brien
(74) *Attorney, Agent, or Firm* — Andrew Wilford

(57) ABSTRACT

A hinge for recessed installation between a door frame and a door panel has first and second housings adapted for recessing in the door frame and an edge of the door panel, a pair of links having ends pivoted in the housings and pivoted together about a vertical axis extending in a vertical direction perpendicular to mutually perpendicular first and second horizontal directions, and two supports in the second housing in which the respective ends of the links are pivoted. Respective adjusting screws extend in the second horizontal direction and are braced between the supports and the second housing such that rotation of each adjusting screws shifts the respective support in the second housing in the second horizontal direction. Respective pairs of guide faces spaced apart in the direction flank each of the supports.

5 Claims, 4 Drawing Sheets

(51) Int. Cl.

| | |
|---|---|
| ***E05D 3/06*** | (2006.01) |
| ***E05D 5/02*** | (2006.01) |
| ***E05D 7/00*** | (2006.01) |

(56) References Cited

U.S. PATENT DOCUMENTS

| | | | | |
|---|---|---|---|---|
| 6,829,808 | B2 * | 12/2004 | Neukotter | E05D 3/186 16/366 |
| 7,861,378 | B2 * | 1/2011 | Neukotter | E05D 3/06 16/237 |
| 8,196,265 | B2 * | 6/2012 | Neukoetter | E05D 3/186 16/236 |
| 8,434,197 | B2 * | 5/2013 | Oshima | E05D 3/186 16/241 |
| 8,621,717 | B2 * | 1/2014 | Liermann | E05D 3/186 16/364 |
| 8,656,560 | B2 * | 2/2014 | Liermann | E05D 7/0423 16/236 |
| 8,683,651 | B2 * | 4/2014 | Liermann | E05D 7/04 16/235 |
| 8,863,361 | B2 * | 10/2014 | Neukoetter | E05D 3/186 16/366 |
| 9,190,792 | B2 * | 11/2015 | Dreisewerd | E05D 3/186 |
| 2010/0115729 | A1 * | 5/2010 | Neukoetter | E05D 3/186 16/235 |
| 2015/0031224 | A1 * | 1/2015 | Dreisewerd | E05D 3/186 439/165 |
| 2017/0030120 | A1 * | 2/2017 | Dreisewerd | E05D 7/0423 |

* cited by examiner

RECESSED DOOR HINGE

FIELD OF THE INVENTION

The present invention relates to a recessed door hinge. More particularly this invention concerns such a hinge recessed in the edge of a door panel and in a door frame.

BACKGROUND OF THE INVENTION

A typical such door hinge has a first housing and a second housing that can be fitted into recesses in the door frame and a narrow edge of the door panel, and a link assembly that connects the housings and has a least two links connected to one another pivotal at a vertical hinge pin. The link assembly is rotatable in the second housing in two separate inserts that are spaced apart from one another. These inserts are each adjustable relative to the second housing by a respective adjusting screw in a second horizontal direction perpendicular to a front face of the second housing.

The alignment of the vertical axis as well as the horizontal direction relates to the conventional installation situation of the door hinge.

Different configurations are known for concealed door hinges. Compared to door hinges with an exposed hinge knuckle, the advantage is produced that doors can be integrated optimally in planar wall surfaces without the door hinges being visible when the door is closed. As a result, the advantage is produced that when the door is closed the hinges are protected from environmental influences, damage or tampering. Furthermore, due to the form of the link assembly specially adapted pivoting sequences can be provided, in order also for example to be able to open doors with an offset. Finally, concealed door hinges frequently have an opening angle of 180°.

In order that the door panel can still be adjusted in the door frame even after installation, door hinges frequently have adjusting mechanisms for adjustment in three directions. The height of the door panel in the door frame can be adjusted by a height adjustment in the vertical direction. With a lateral adjustment in the horizontal direction parallel to the external surface of the door panel, the door panel can be moved laterally relative to its closed position inside the door frame. Finally, an adjustment of the door panel in the direction of its thickness is possible, which is designated as a compression adjustment. This designation derives from the fact that an adjustment in the direction of the thickness as a rule also determines the force with which a seal between the door panel and the door frame is compressed.

In order to make a lateral adjustment, ultimately the distance between the two housings must be changed relative to the closed position of the door panel. In this connection it is usual that one of the two housings has inserts supporting the link assembly for adjustment in the corresponding second horizontal direction. Generic configurations of door hinges to be recessed are known from U.S. Pat. Nos. 6,829,808, 8,196,265, U.S. 2010/0115729, U.S. Pat. Nos. 8,863,361 and 8,656,560.

According to the last-mentioned U.S. Pat. No. 8,656,560, a simple headed screw retained by a screw head in a seat in the associated insert can be used as an adjusting screw. This seat is then opened laterally in order to be able to introduce the adjusting screw easily during installation. The screw head is then retained by positive engagement in the adjustment direction. According to U.S. Pat. No. 8,656,560 it is not possible to avoid a certain movability of the adjusting screw inside the seat.

OBJECTS OF THE INVENTION

It is therefore an object of the present invention to provide an improved recess-mount hinge.

Another object is the provision of such an improved recess-mount hinge that overcomes the above-given disadvantages, in particular that is operates with greater rigidity and less play.

SUMMARY OF THE INVENTION

A hinge for recessed installation between a door frame and a door panel has according to the invention first and second housings adapted for recessing in the door frame and an edge of the door panel, a pair of links having ends pivoted in the housings and pivoted together about a vertical axis extending in a vertical direction perpendicular to mutually perpendicular first and second horizontal directions, and two supports in the second housing in which the respective ends of the links are pivoted. Respective adjusting screws extend in the second horizontal direction and are braced between the supports and the second housing such that rotation of each adjusting screws shifts the respective support in the second housing in the second horizontal direction. Respective pairs of guide faces spaced apart in the direction flank each of the supports.

The present invention is based in particular on the knowledge that, especially in the case of long-term use of a door hinge, even a slight play can lead to an irregular loading and thus to increased wear. A particularly uniform distribution of force can only be achieved if the play is minimized.

Starting from a door hinge with the features described in the introduction, according to a first embodiment of the invention the inserts are each retained in positive engagement in the vertical direction between two opposing surfaces that are spaced apart from one another, and the inserts can move in the second horizontal direction.

On a side opposite the link assembly, the inserts according to a preferred embodiment of the invention have at least one guide structure in the form of a groove or projecting rib that extends in the second horizontal direction and cooperates with a complementary guide structure of the second housing in the form of a projecting rib or groove. Due to such interfitting guide structures, first of all a fixing in the vertical direction is possible, so that, even taking account of the further opposing surface, a tilting of the inserts forward and backward can be avoided. The complementary guide structures that are associated with one another can also be used to enable lateral stabilization in the first horizontal direction, so that tilting is also prevented relative to this direction. Thus suitable opposing surfaces can ensure that the inserts can be moved primarily only in the second horizontal direction.

The second housing can form a seat cavity that is U-shaped in cross-section perpendicular to the vertical, and the ends of the links are usually also arranged in this seat cavity. In the preferred embodiment of the door hinge according to the invention with a guide slot on each insert, the corresponding hinge bracket is introduced into the associated seat cavity when the door hinge is closed from an open position.

Starting from such a U-shaped seat cavity, for each of the inserts a rib extending in the second horizontal direction can be provided as an opposing surface, on which the associated insert rests with its side facing the link assembly.

According to a further aspect of the present invention, in addition to or as an alternative to fixing the inserts in the vertical direction by spaced-apart opposing surfaces the inserts have a seat for the adjusting screw in which a screw head of the respective adjusting screw is retained by an open side perpendicular to the second horizontal direction, and on the open side of the seat a web of the second housing extends in the second horizontal direction, engages in the seat and laterally delimits the screw head. The dimensions of this web can be selected so that the screw head is retained tightly in the seat, so that an undesirable play is avoided.

The second housing and the inserts are preferably formed as metal castings, for which in particular a zinc pressure die-casting may be considered.

As already described in the introduction, according to a preferred embodiment of the invention the link assembly has two links one of which is rotatable on the inserts about a vertical axis of rotation and the other of which is movably and rotatably arranged in guide grooves of the inserts. Such a link assembly is usually supported on the second housing in a similar manner.

The hinge construction according to the prior art described in the introduction is then produced, in which the kinematics of the door hinge can be varied by the form of the two cooperating links, the arrangement of the axes of rotation as well as the run of the guide grooves. Alternatively, a link assembly in the manner of a scissor joint is possible, which for example has a plurality of links with a total of seven pivot pins. The alternative configurations of the link assembly are known for example from JP 6-288139.

BRIEF DESCRIPTION OF THE DRAWING

The invention is explained in greater detail below with reference to drawings showing only one embodiment. Therein.

SPECIFIC DESCRIPTION OF THE INVENTION

Figure 1:
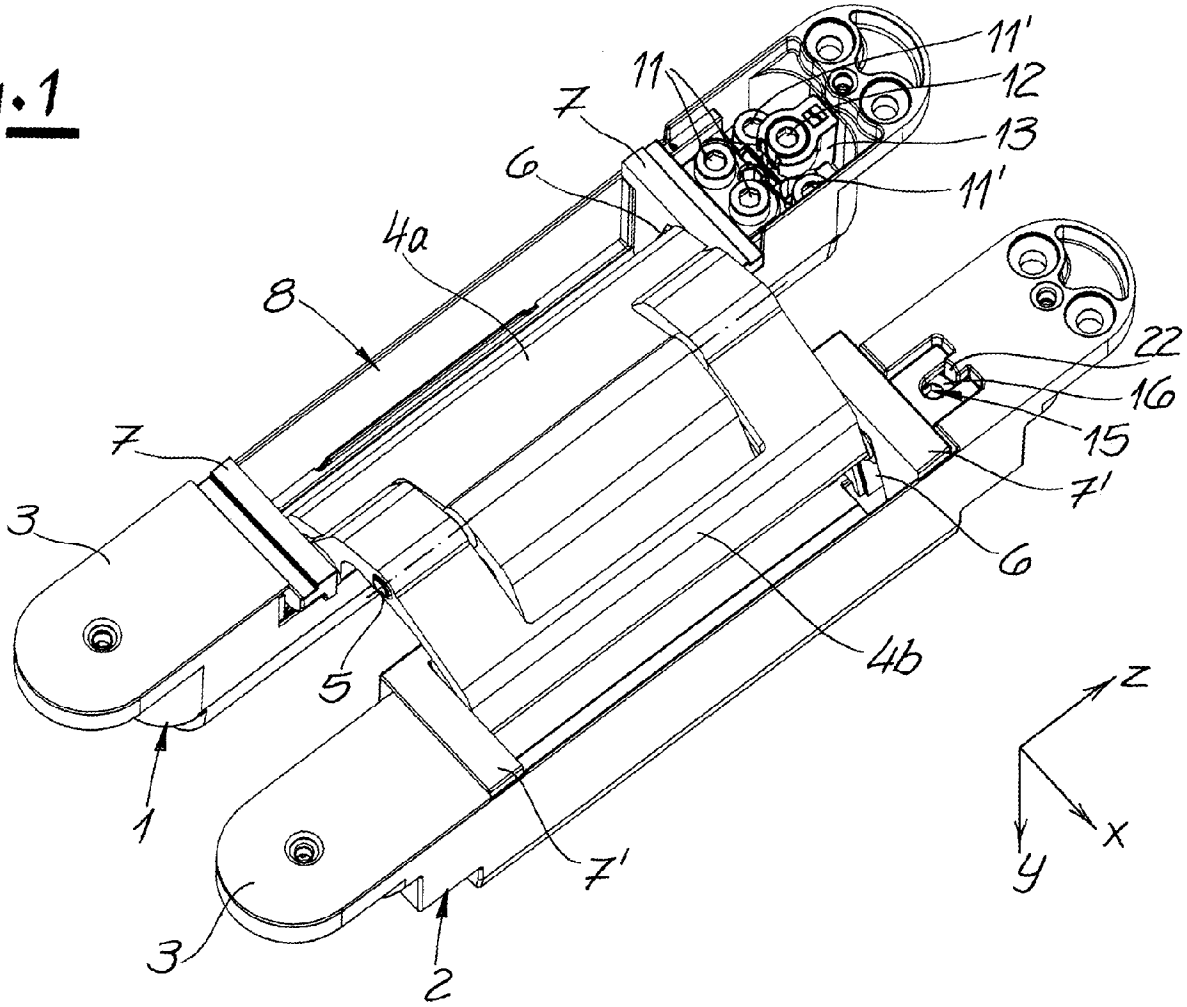
FIG. 1 is a view of a door hinge according to the invention.

As seen in FIG. 1 a recess-mount door hinge between an unillustrated door panel and frame in an open position has a cast-metal first housing 1 and a cast-metal second housing 2 pivotal through 180° relative to one another between the illustrated open position and a closed position about a vertical axis defined by a hinge pin 5. FIG. 1 further shows that the ends of the housings 1 and 2 are usually closed by covers 3, but in order to clarify the construction these covers 3 have not been shown in FIG. 1 at the upper ends of the housings 1 and 2.

The two housings 1 and 2 are connected to one another in a manner known per se by an assembly consisting of two links 4*a* and 4*b*. The two links 4*a* and 4*b* are pivotally connected to one another at the hinge pin 5 at the pivot axis extending in a vertical direction z. Furthermore, as known in the prior art (see U.S. patent application Ser. No. 14/341,810 filed 27 Jul. 2014) each of the links 4*a* and 4*b* is pivotal in both of the housings 1 and 2, with one end pivotal about an axis fixed in one of the housings 1 and 2 and the other end longitudinally movably in guide grooves 6 in the other of the housings 1 and 2. This way, as the two housings 1 move from the illustrated open position to an unillustrated folded position with their outer faces parallel and either very close or actually touching, the links 4*a* and 4*b* can be pushed back into the housings 1 and 2 as is well known in the art.

Figure 2:
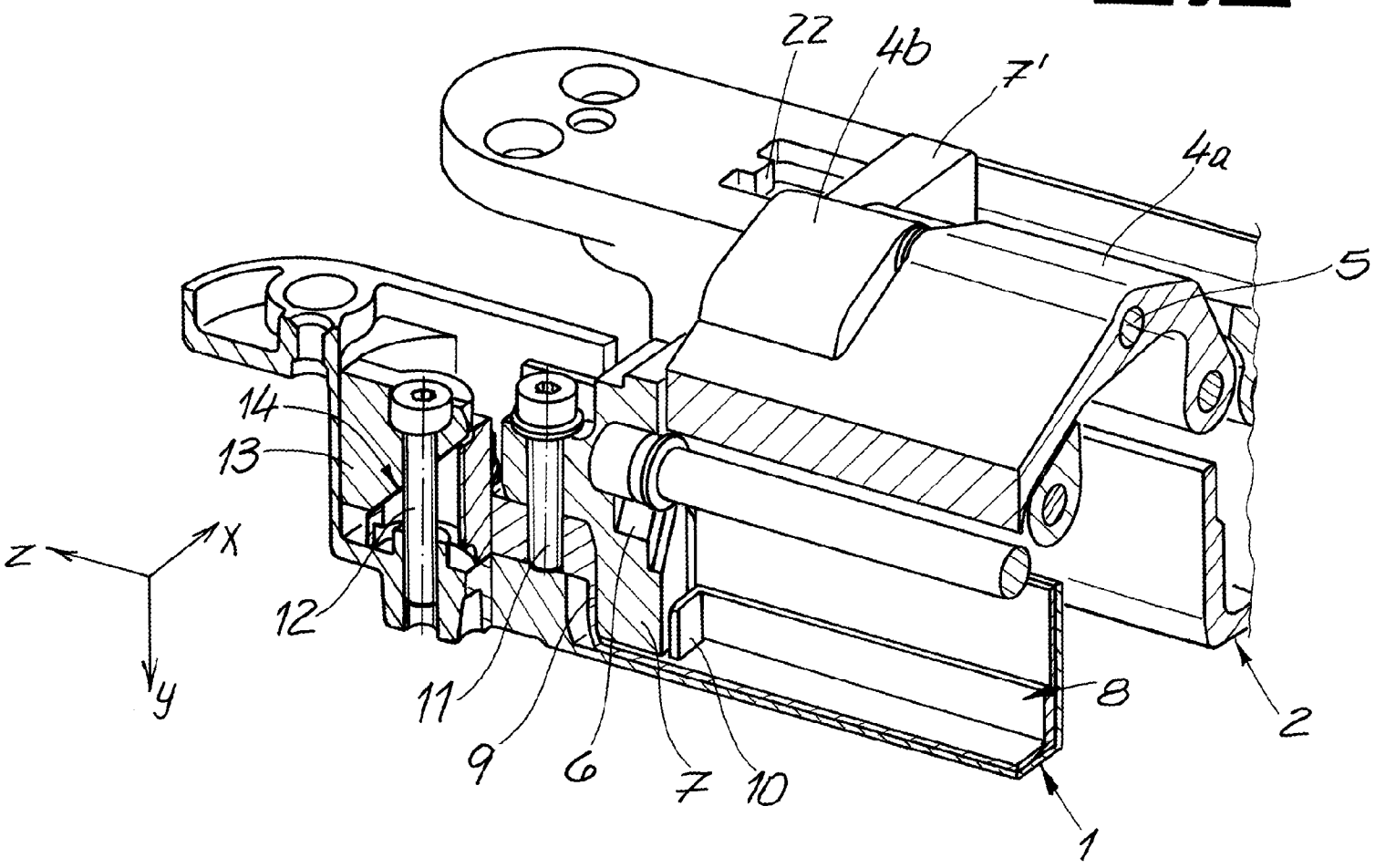
FIG. 2 is a longitudinal section through a first housing of the door hinge of FIG. 1.
Figure 3:
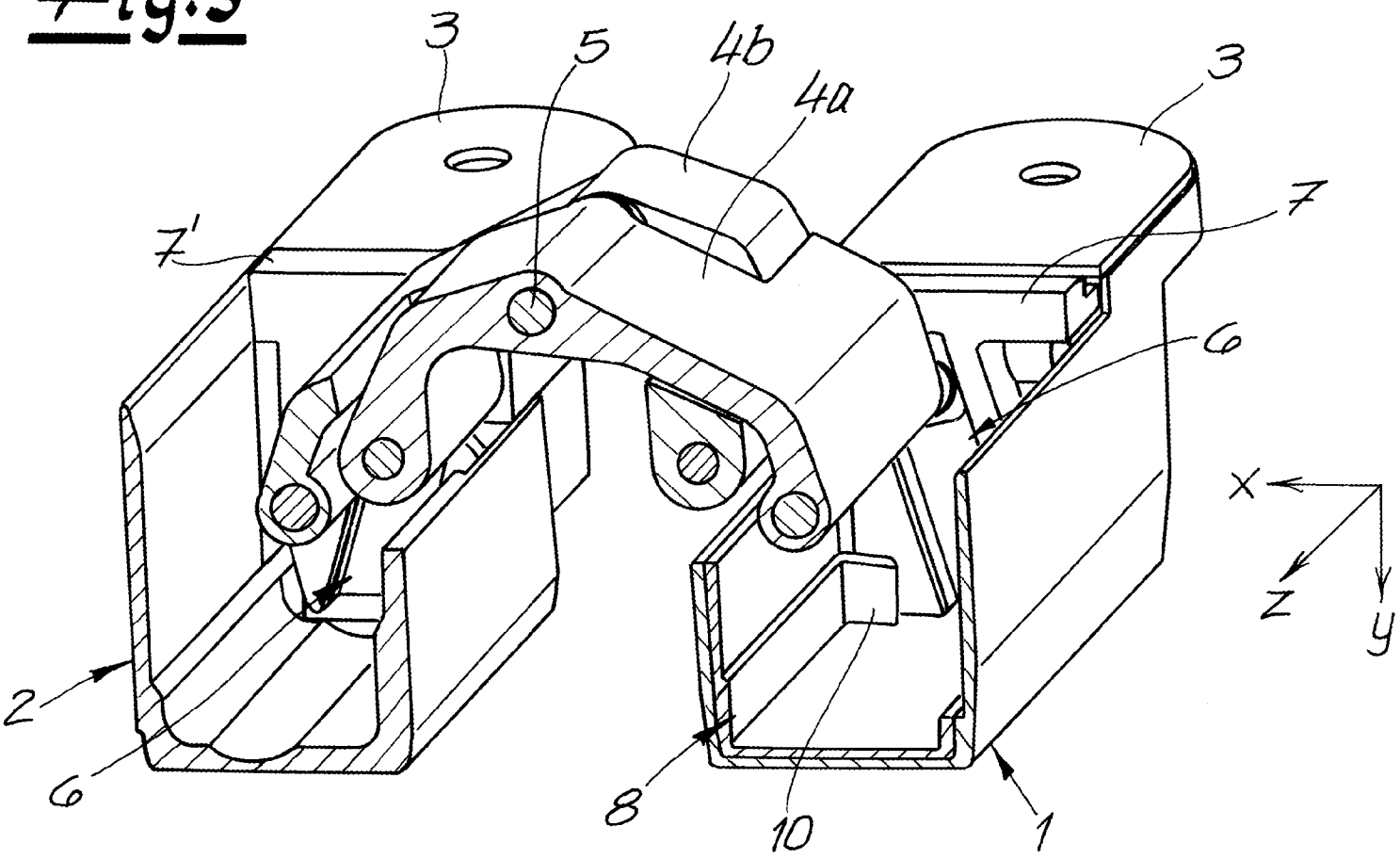
FIG. 3 is a cross section through the door hinge according to FIG. 1.

According to FIGS. 2 and 3 the two links 4*a* and 4*b* are retained in the first housing 1 on two separate but identical inserts 7 that are spaced apart from one another in the vertical direction z. The inserts 7 each form a respective one the two confronting holes for the ends of pin defining the fixed axis of one of the ends of one of the links 4*a* or 4*b* and the two grooves 6 in which the ends of the other slidable or movable pivot pin of end the other of the links 4*a* or 4*b* are seated. The inserts 7 are on an integral rigid connector body 8 extending vertically along the link assembly. FIGS. 2 and 3 show that the connector body 8 is fixed in a seat of the first housing 1 and is U-shaped in a horizontal section transverse to the vertical z, so that the connector body 8 is only limitedly movable in a vertical direction z with minimal lateral play relative to the first housing 1 in a horizontal direction x.

More particularly as shown in FIGS. 2 and 3, the body 8 is formed of cast metal and has massive ends forming slide surfaces 9 and in which screws 11 described below are seated and a thinner box-shaped central part in which is secured or which is formed with a U-shaped bar having right-angle ends forming surfaces 10 confronting the surfaces 9. This entire body 8 can move with the inserts 7 only limitedly vertically in the housing 1 under the action of the wedge assembly 14 as described below.

FIG. 2 further shows that the inserts 7 are each retained in positive engagement against movement on the connector body 8 in a vertical direction by the substantially horizontal surfaces 9 and 10 of the connector body 8.

The surface 9 against which each insert 7 rests on the side thereof opposite the link assembly may have a slightly angled position and/or bend, which within the context of the invention is still designated without restriction as horizontal since the surfaces 9 and 10 of the body 8 extend at most at only a small angle of a few degrees to the horizontal directions x and y. In particular, in a preferred embodiment of the housing 1 and 2 of the connector body 8 as well as the inserts 7 as metal castings, angles are for example necessary for demolding during manufacture. This produces the advantage that the substantially horizontal surface 9 and the side of the inserts 7 abutting this wall can have a complementary shape precisely coordinated therewith.

It can be seen from FIG. 2 that—as explained above—the inserts 7 are retained and supported in a vertical direction z between the substantially horizontal surfaces 9 and 10, so that tilting of the inserts 7 is avoided and the result is particularly high stability. Furthermore, the inserts 7 are fastened to the connector body 8 by retaining screws 11. If the inserts 7 have longitudinal slots extending in the horizontal direction x for the retaining screws 11, adjustment of the door hinge in terms of a compression adjustment in the first horizontal direction x can also be achieved in a simple manner. The co-ordination of the first horizontal direction x and a second horizontal direction y relates to the orientation of the closed door panel in the door frame. The first horizontal direction x normally extends in the direction of the thickness of the door panel, whereas the second horizontal direction y extends parallel to the faces of the closed door panel.

Since at least with the retaining screws 11 tightened the inserts 7 are retained without play and precisely on the connector body 8, and the assembly formed by the connector body 8 together with the inserts 7 and the links 4*a* and 4*b* can be adjusted in the vertical direction z relative to the first main body 1, slight play can be provided in a vertical direction between the links 4*a* and 4*b* and the inserts 7, and this play is also maintained and makes movement of the links 4*a* and 4*b* on the inserts 7 possible without jamming.

According to FIG. 2 adjustment in the vertical direction z can be performed in a particularly simple manner by an adjusting mechanism that has a screw 12 seated in the housing 1 and bearing on an adjustment wedge 13. The screw 12 can shift the wedge 13 in the direction y along a horizontal end face of the first housing 1 and thereby act on an angled wedge face 14 of the connector body 8, so that the connector body 8 can be shifted in the vertical direction z along with the two inserts 7 and the link assembly 4*a*, 4*b*. FIG. 1 further shows that further retaining screws 11 are provided transversely flanking the adjustment screw 12 so as to fix the connector body 8 on the first housing 1. These screws 11' are threaded into the respective insert 7 and pass through slots extending in the direction x in the body 8 to allow for transverse adjustment of the hinge. When thus fixed by the screws 11 all of the forces acting on the connector body 8 do not act on the adjusting mechanism after the required door-panel height has been set during installation.

Thus within the context of the described embodiment, adjustment in the vertical direction z as well as in the first horizontal direction x is possible on the first housing 1, whereas adjustment in the second horizontal direction y is provided on the second housing 2. According to FIG. 4 two inserts 7' formed as metal castings like the inserts 7 that are spaced apart from one another and support the links 4*a* and 4*b* are also provided on the second housing 2. These inserts 7', which are braced between guide faces 9 and 10 in the second housing 2 like the inserts 7 in the first housing 1, are each movable by an adjusting screw 15 in the manner of an actuating spindle in the second horizontal direction y perpendicular to a front face of the second housing 2. In other words, the inserts 7' can be screwed to different depths into the second housing 2.

Figure 4:
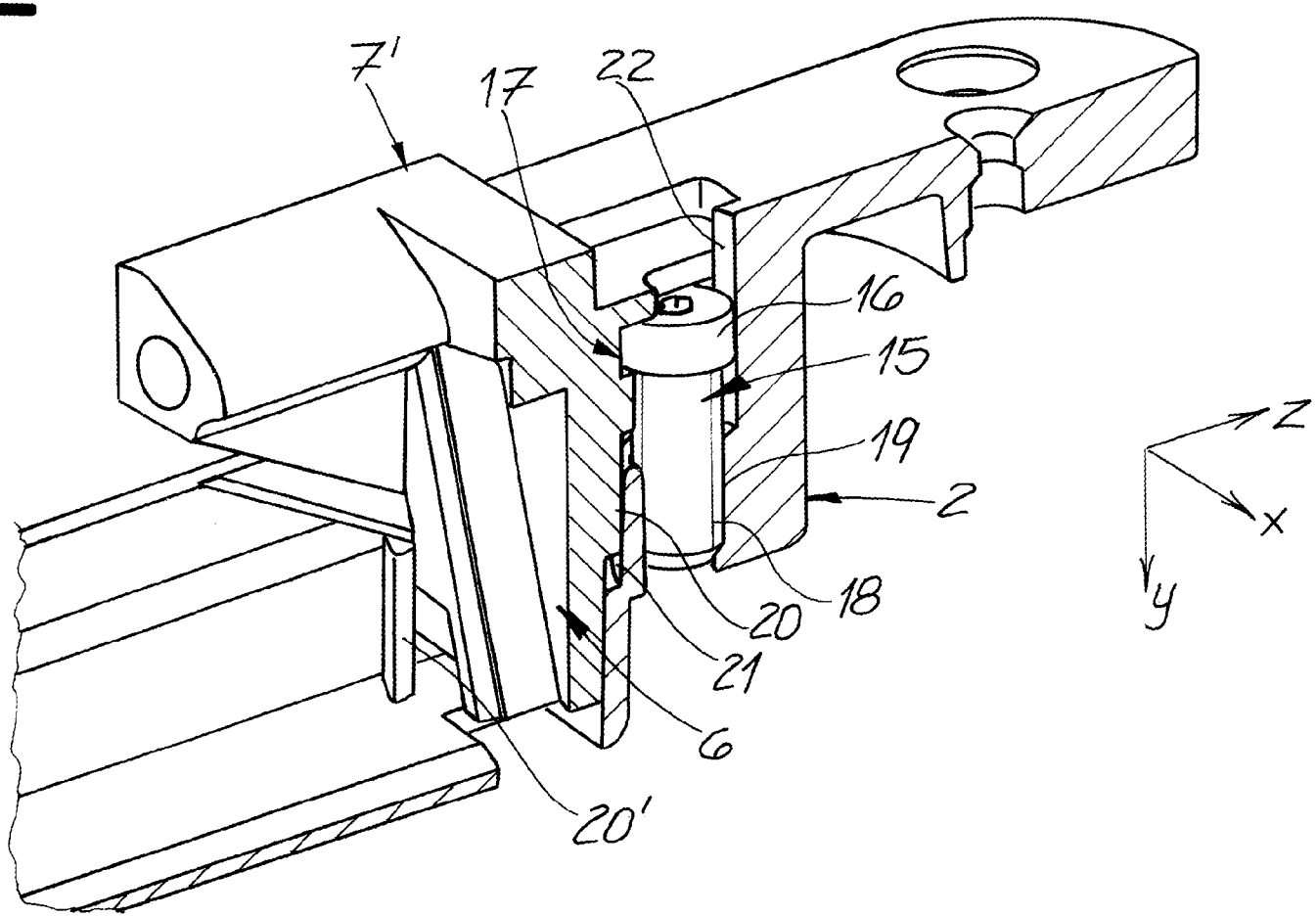
FIG. 4 is a detail of a longitudinal section through the second housing.

Here, the inserts 7' are guided in positive engagement in the second horizontal direction y by the faces 9 and 10 not shown in FIG. 4, and, as in the above-described embodiment, the adjusting screw 15 with a screw head 16 is inserted from an open side in the horizontal direction y into a seat 17 in the associated insert 7' and is retained in the seat 17 against movement in the second horizontal direction y relative to the insert 7'. In horizontal cross-section the seat 17 surrounds the screw head 16 approximately in a C shape, and the underside of the screw head 16 is retained by lateral arms of the seat 17. A threaded shank 18 of the adjusting screw 15 extends out of the end of the seat 17 and is received in a threaded bore 19 of the second housing 2.

In order to avoid play and a certain tilting of the inserts 7', different measures are provided within the context of the invention.

First of all, the inserts 7' are retained in positive engagement against movement in the vertical direction z between the two opposing and confronting faces 9 and 10 of the housing 2 (see FIG. 2) that are spaced apart in the direction z from one another, and the inserts 7' are also slidable on these surfaces 9 and 10 in the second horizontal direction y. According to FIG. 4 the inserts 7' have, on an outside face turned away from the link assembly, a guide structure in the form of a projecting rib 20 that extends in the second horizontal direction y and engages in a complementary guide groove 21 of the second housing 2 extending in the direction y. Due to these complementary guides formations 20 and 21 it is possible to prevent not only tilting forward and backward, but also lateral tilting.

The second housing 2 is approximately U-shaped in cross-section in its central region when viewed in the vertical direction z, and forms a seat cavity for the ends of the links 4*a* and 4*b* and also for the inserts 7'. A rib 20' also extending in the second horizontal direction y is provided as an opposing surface on at least one of the lateral sides of the U-shaped seat cavity of the housing 2.

Guiding of the inserts 7' largely without play or tilting can already be achieved by the described ribs 20 and 20' and the groove 21.

As an additional and/or alternative measure, play can also be reduced by limiting the movability of the adjusting screw 15 in the installed state. For this purpose, a web 22 of the second housing 2 extending in the second horizontal direction y is provided on an inner face of the seat 17, engages in the seat 17, and laterally delimits the screw head 16.

I claim:

1. A hinge for recessed installation between a door frame and a door panel, the hinge comprising:

first and second housings adapted for recessing in the door frame and an edge of the door panel;

respective pairs of guide faces spaced apart in the vertical direction and fixed in the first housing;

a pair of links each having one end pivoted in a respective one of the housings and an opposite end slideable and pivotable in the other of the housings and, the links pivoted together about a vertical axis extending in a vertical direction perpendicular to mutually perpendicular first and second horizontal directions;

two supports in the second housing in which the respective ends of the links are pivoted;

respective adjusting screws extending in the second horizontal direction and braced between the supports and the second housing such that rotation of each adjusting screw shifts the respective support in the second housing in the second horizontal direction; and respective pairs of guides spaced apart in the vertical direction in the second housing, flanking each of the respective supports, and blocking vertical movement of the respective supports in the second housing.

2. The hinge defined in claim 1, further comprising: complementary interfitting groove and ridge structures formed on and between each of the supports and the second housing.

3. The hinge defined in claim 1, wherein the second housing forms a seat cavity receiving the supports and the respective ends of the links and is formed in the cavity with respective ribs extending in the second horizontal direction, forming the respective guides, and along which the respective supports are horizontally slidable.

4. The hinge defined in claim 1, wherein the screws each have a shank threaded into the respective support and a head, each support being formed with a seat open in the vertical direction, closed in the second horizontal direction, and partially receiving the head of the respective screw, each support being formed with a rib extending in the second horizontal direction, extending in the first horizontal direction from the respective support, and bearing in the first horizontal 9 direction on the head of the respective screw.

5. The hinge defined in claim 1, wherein the supports and second housing are of cast metal.

* * * * *